US010186187B2

(12) United States Patent
Tsai et al.

(10) Patent No.: US 10,186,187 B2
(45) Date of Patent: Jan. 22, 2019

(54) ORGANIC LIGHT-EMITTING DIODE DISPLAY WITH PULSE-WIDTH-MODULATED BRIGHTNESS CONTROL

(71) Applicant: Apple Inc., Cupertino, CA (US)

(72) Inventors: Tsung-Ting Tsai, Taipei (TW); Chin-Wei Lin, Cupertino, CA (US); Shih Chang Chang, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 14/687,081

(22) Filed: Apr. 15, 2015

(65) Prior Publication Data

US 2016/0275845 A1 Sep. 22, 2016

Related U.S. Application Data

(60) Provisional application No. 62/133,764, filed on Mar. 16, 2015.

(51) Int. Cl.
*G09G 3/20* (2006.01)
*G09G 3/32* (2016.01)
(Continued)

(52) U.S. Cl.
CPC ..... *G09G 3/2018* (2013.01); *G09G 3/2003* (2013.01); *G09G 3/3258* (2013.01);
(Continued)

(58) Field of Classification Search
None
See application file for complete search history.

(56) References Cited

U.S. PATENT DOCUMENTS 6,069,597 A 5/2000 Hansen
8,264,453 B2 9/2012 Yang et al.
(Continued)

FOREIGN PATENT DOCUMENTS

CN 1885396 12/2006
CN 101978415 2/2011
(Continued)

OTHER PUBLICATIONS

Gupta, U.S. Appl. No. 14/535,604, filed Nov. 7, 2014.

*Primary Examiner* — Benjamin C Lee
*Assistant Examiner* — Krishna P Neupane
(74) *Attorney, Agent, or Firm* — Treyz Law Group, P.C.; G. Victor Treyz; Jason Tsai

(57) ABSTRACT

A display may have an array of pixels arranged in rows and columns. Display driver circuitry may load data into the pixels via data lines that extend along the columns. The display driver circuitry may include gate driver circuitry that supplies horizontal control signals to rows of the pixels. The horizontal control signals may include emission enable signals for controlling emission enable transistors and scan signals for controlling switching transistors. During an emission phase of operation for the display, the emission enable signal may be pulse-width modulated by the emission control gate driver circuits in the gate driver circuitry to control the output of the light-emitting diodes. The emission control gate driver circuits may be controlled using an emission start signal and a pair of two-phase clocks.

16 Claims, 10 Drawing Sheets

(51) Int. Cl.
*G09G 3/3266* (2016.01)
*G09G 3/3258* (2016.01)
*G09G 3/3233* (2016.01)

(52) U.S. Cl.
CPC ..... *G09G 3/3266* (2013.01); *G09G 3/2014* (2013.01); *G09G 3/2081* (2013.01); *G09G 3/3233* (2013.01); *G09G 2300/0819* (2013.01); *G09G 2300/0852* (2013.01); *G09G 2300/0861* (2013.01); *G09G 2310/0251* (2013.01); *G09G 2310/0286* (2013.01); *G09G 2310/08* (2013.01); *G09G 2320/064* (2013.01); *G09G 2320/0626* (2013.01); *G09G 2320/0666* (2013.01)

(56) References Cited

U.S. PATENT DOCUMENTS

| | | | | |
|---|---|---|---|---|
| 8,305,370 | B2 | 11/2012 | Song et al. | |
| 8,334,659 | B2 | 12/2012 | Aurongzeb et al. | |
| 8,711,084 | B2 | 4/2014 | Lee et al. | |
| 8,816,944 | B2 | 8/2014 | Kim et al. | |
| 2003/0098828 | A1 | 5/2003 | Hunter et al. | |
| 2003/0214493 | A1 | 11/2003 | Akimoto et al. | |
| 2004/0104686 | A1 | 6/2004 | Shin et al. | |
| 2005/0253835 | A1 | 11/2005 | Kawase | |
| 2006/0055687 | A1 | 3/2006 | Sheu et al. | |
| 2009/0167649 | A1 | 7/2009 | Ishizuka | |
| 2009/0201231 | A1* | 8/2009 | Takahara | G09G 3/3233 345/76 |
| 2010/0207968 | A1* | 8/2010 | Kim | G09G 3/3266 345/691 |
| 2011/0025679 | A1* | 2/2011 | Park | G09G 3/3266 345/213 |
| 2011/0102389 | A1 | 5/2011 | Han | |
| 2012/0112940 | A1 | 5/2012 | Sohn | |
| 2013/0082615 | A1 | 4/2013 | Williams et al. | |
| 2014/0139139 | A1 | 5/2014 | Li et al. | |
| 2014/0354698 | A1 | 12/2014 | Lee et al. | |
| 2015/0015554 | A1* | 1/2015 | Kim | G09G 3/3208 345/208 |
| 2015/0061982 | A1* | 3/2015 | Woo | G09G 3/3266 345/82 |
| 2015/0138180 | A1* | 5/2015 | Park | G09G 3/3233 345/212 |
| 2016/0035262 | A1* | 2/2016 | Lee | G11C 19/28 345/690 |

FOREIGN PATENT DOCUMENTS

| | | |
|---|---|---|
| CN | 103632633 A | 3/2014 |
| CN | 104282266 | 1/2015 |
| CN | 205354618 U | 6/2016 |
| EP | 2701142 | 2/2014 |
| WO | WO2006035246 A1 | 4/2006 |

* cited by examiner

ORGANIC LIGHT-EMITTING DIODE DISPLAY WITH PULSE-WIDTH-MODULATED BRIGHTNESS CONTROL

This application claims the benefit of provisional patent application No. 62/133,764, filed Mar. 16, 2015, which is hereby incorporated by reference herein in its entirety.

BACKGROUND

This relates generally to electronic devices with displays, and, more particularly, to organic light-emitting diode displays.

Electronic devices often include displays. Displays such as organic light-emitting diode displays have pixels with light-emitting diodes. It can be challenging to accurately control the brightness and color of organic light-emitting diode pixels. At low gray levels, for example, the efficiency of the organic light-emitting diodes may be dependent on drive current. The variation in the efficiency of the organic light-emitting diodes and the differing responses of emissive organic materials in diodes of different colors may make it difficult to calibrate the brightness and color of the display accurately.

It would therefore be desirable to be able to provide displays such as organic light-emitting diode displays that exhibit enhanced performance.

SUMMARY

A display may have an array of pixels arranged in rows and columns. Each pixel may include a light-emitting diode, a drive transistor coupled to the light-emitting diode, an emission enable transistor coupled in series with the drive transistor and the light-emitting diode, and switching transistors.

Display driver circuitry may load data into the pixels via data lines that extend along the columns. The display driver circuitry may include gate driver circuitry that supplies horizontal control signals to rows of the pixels.

The horizontal control signals may include emission enable signals for controlling the emission enable transistors and scan signals for controlling the switching transistors. The emission enable signals may be pulse-width modulated by the emission control gate driver circuits in the gate driver circuitry to control the output of the light-emitting diodes.

The emission control gate driver circuits may be controlled using an emission start signal and a pair of two-phase clocks. A first of the clocks may be an emission control clock that controls transitions in the emission enable signal associated with performing threshold voltage compensation operations on the drive transistors. A second of the clocks may be a pulse-width modulation control clock that controls transitions in the emission enable signal associated with the starting and ending of pulse-width modulation on and off periods in which the light-emitting diode is respectively turned on or off.

DETAILED DESCRIPTION

Figure 1:
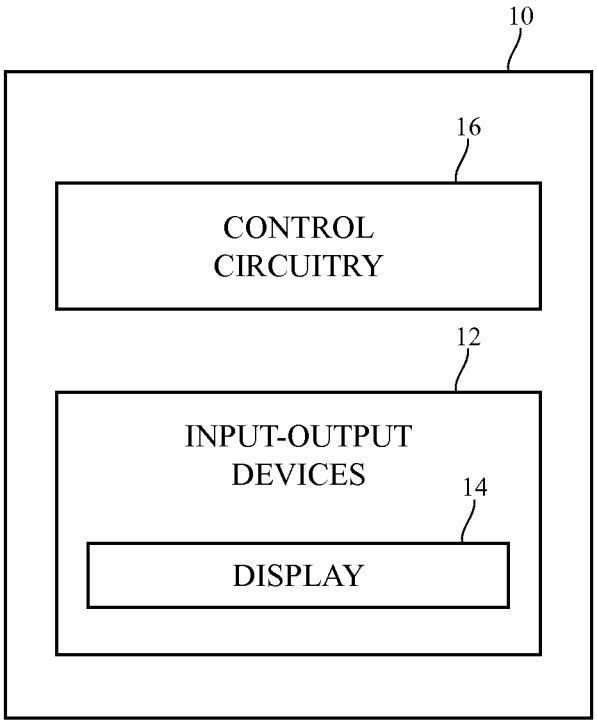
FIG. 1 is a schematic diagram of an illustrative electronic device having a display in accordance with an embodiment.

An illustrative electronic device of the type that may be provided with a display is shown in FIG. 1. As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Control circuitry 16 may be used to run software on device 10 such as operating system code and applications. During operation of device 10, the software running on control circuitry 16 may display images on display 14 using an array of pixels in display 14.

Device 10 may be a tablet computer, laptop computer, a desktop computer, a display, a cellular telephone, a media player, a wristwatch device or other wearable electronic equipment, or other suitable electronic device.

Display 14 may be an organic light-emitting diode display or may be a display based on other types of display technology. Configurations in which display 14 is an organic light-emitting diode display are sometimes described herein as an example. This is, however, merely illustrative. Any suitable type of display may be used in device 10, if desired.

Display 14 may have a rectangular shape (i.e., display 14 may have a rectangular footprint and a rectangular peripheral edge that runs around the rectangular footprint) or may have other suitable shapes. Display 14 may be planar or may have a curved profile.

Figure 2:
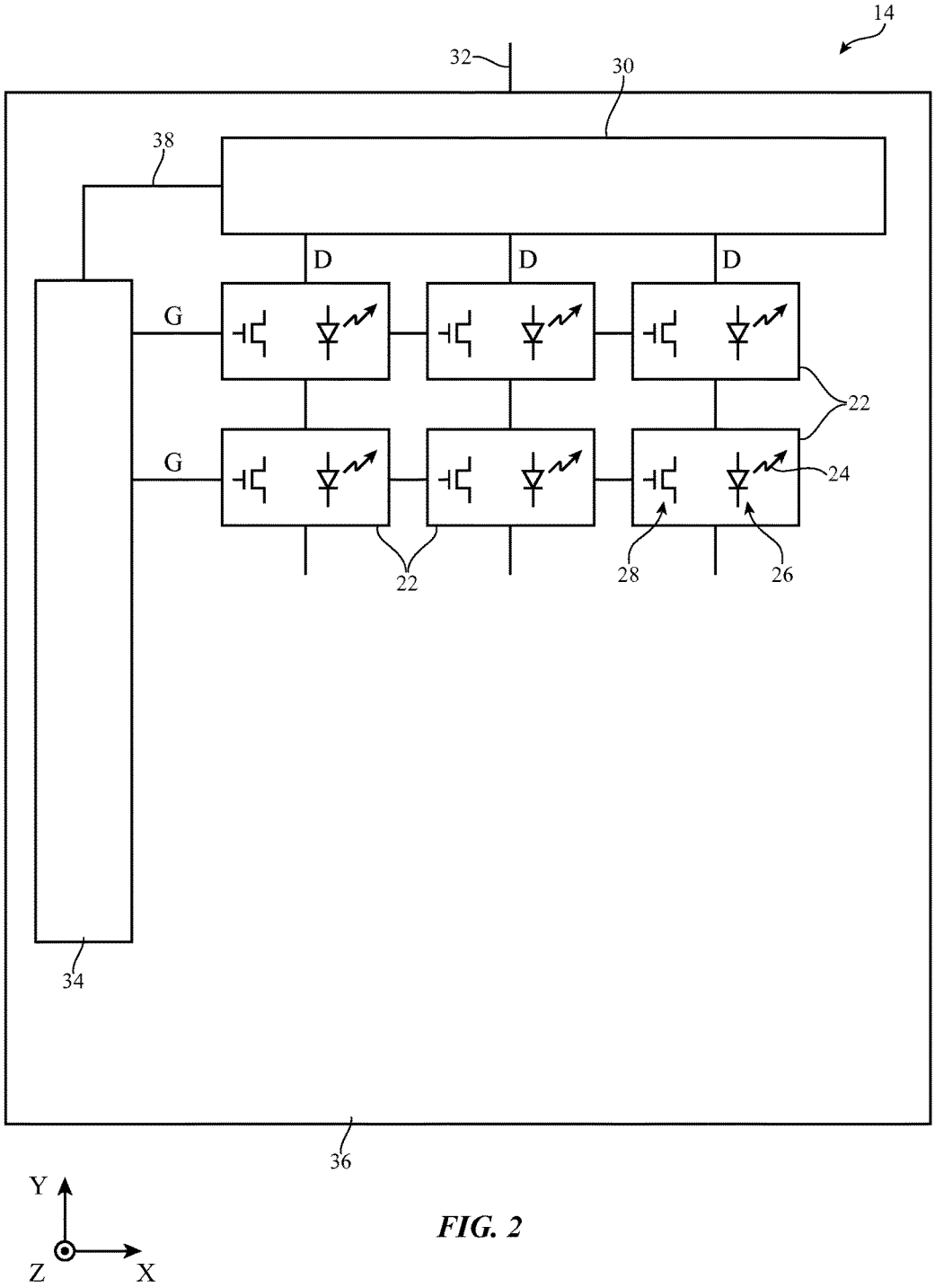
FIG. 2 is a top view of an illustrative display in an electronic device in accordance with an embodiment.

A top view of a portion of display 14 is shown in FIG. 2. As shown in FIG. 2, display 14 may have an array of pixels 22 formed on substrate 36. Substrate 36 may be formed from glass, metal, plastic, ceramic, or other substrate materials. Pixels 22 may receive data signals over signal paths such as data lines D and may receive one or more control signals over control signal paths such as horizontal control lines G (sometimes referred to as gate lines, scan lines, emission control lines, etc.). There may be any suitable number of rows and columns of pixels 22 in display 14 (e.g., tens or more, hundreds or more, or thousands or more). Each pixel 22 may have a light-emitting diode 26 that emits light 24 under the control of a pixel control circuit formed from thin-film transistor circuitry such as thin-film transistors 28 and thin-film capacitors). Thin-film transistors 28 may be polysilicon thin-film transistors, semiconducting-oxide thin-film transistors such as indium zinc gallium oxide transistors, or thin-film transistors formed from other semiconductors. Pixels 22 may contain light-emitting diodes of different colors (e.g., red, green, and blue) to provide display 14 with the ability to display color images.

Display driver circuitry may be used to control the operation of pixels 22. The display driver circuitry may be formed from integrated circuits, thin-film transistor circuits, or other suitable circuitry. Display driver circuitry 30 of FIG. 2 may contain communications circuitry for communicating with system control circuitry such as control circuitry 16 of FIG. 1 over path 32. Path 32 may be formed from traces on a flexible printed circuit or other cable. During operation, the control circuitry (e.g., control circuitry 16 of FIG. 1) may supply circuitry 30 with information on images to be displayed on display 14.

To display the images on display pixels 22, display driver circuitry 30 may supply image data to data lines D (e.g., data lines that run down the columns of pixels 22) while issuing clock signals and other control signals to supporting display driver circuitry such as gate driver circuitry 34 over path 38. If desired, circuitry 30 may also supply clock signals and other control signals to gate driver circuitry on an opposing edge of display 14.

Gate driver circuitry 34 (sometimes referred to as horizontal control line control circuitry) may be implemented as part of an integrated circuit and/or may be implemented using thin-film transistor circuitry. Horizontal control lines G in display 14 may carry gate line signals (scan line signals), emission enable control signals, and other horizontal control signals for controlling the pixels of each row. There may be any suitable number of horizontal control signals per row of pixels 22 (e.g., one or more, two or more, three or more, four or more, etc.).

Figure 3:
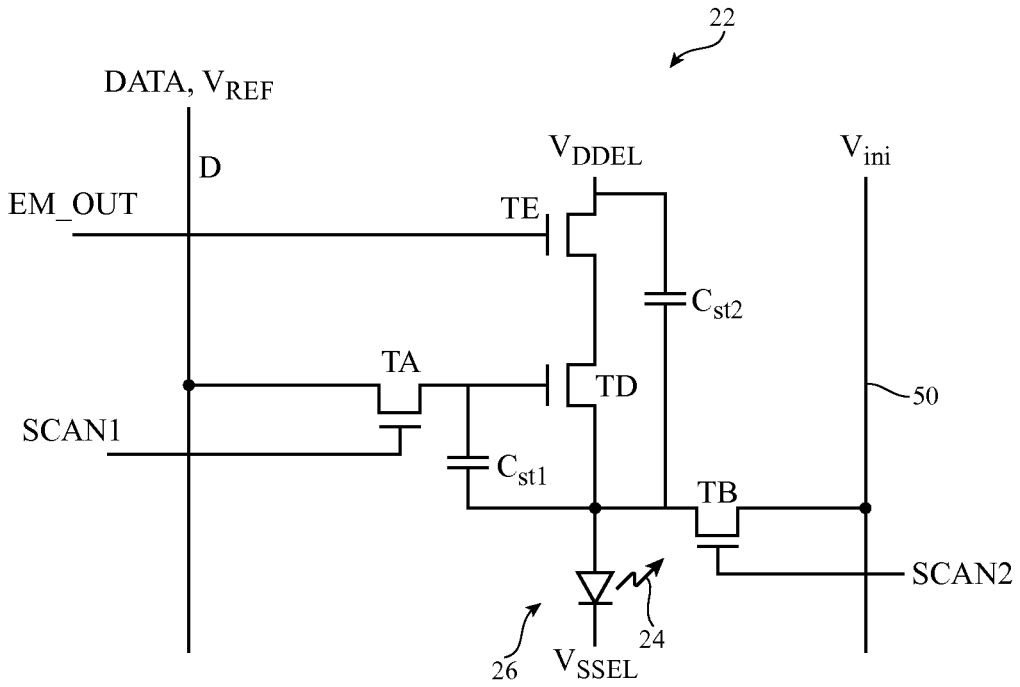
FIG. 3 is a circuit diagram of an illustrative pixel circuit for a display in accordance with an embodiment.

An illustrative pixel circuit for one of pixels 22 is shown in FIG. 3. The configuration of FIG. 3 has four transistors (TA, TE, TD, and TB) and two capacitors (Cst1 and Cst2) and may therefore sometimes be referred to as a 4T2C design. Other types of pixel circuits may be used if desired (e.g., a 6T1C design, a 7T1C design, etc.). The pixel circuitry of FIG. 3 is merely illustrative Pixel circuit 22 uses drive transistor TD to control the flow of current through organic light-emitting diode 26 and thereby control the amount of light 24 that is emitted by diode 26. Emission transistor TE (sometimes referred to as an emission enable transistor) may be coupled in series with drive transistor TD between positive power supply Vddel and ground power supply Vssel. Emission control signal (emission enable signal) EM_OUT may be used to control emission transistor TE.

Transistors TA and TB may sometimes be referred to as switching transistors or scan transistors. Capacitors Cst1 and Cst2 may sometimes be referred to as storage capacitors. Data line D is used to carry data (DATA) during data loading operations and is used to carry a reference voltage Vref during threshold voltage compensation operations (e.g., when compensating transistor TD for variations in threshold voltage). Initialization voltage line Vini is used to provide pixel circuit 22 with an initialization voltage Vini during initialization operations. Scan lines SCAN1 and SCAN2 and emission control line EM_OUT are carried to pixel 22 over gate line paths G of FIG. 2.

During certain operations, such as when displaying image data on display at low gray levels, it can be challenging to accurately control the output of light-emitting diode 26. For example, in a display with 256 gray levels ranging from 0 (black) to 255 (white), it may be challenging to accurately control pixel output at gray levels below 10. Accordingly, display 14 may use pulse width modulation (PWM) to control pixel light output at low gray levels (and, if desired, at high gray levels as well).

With a pulse-width-modulation scheme, the display driver circuitry of display 14 may modulate the emission control signal EM_OUT so that this signal contains both off periods Toff (in which EM_OUT is deasserted) and on periods Ton (in which EM_OUT is asserted). When PWM control is active (e.g., at low gray levels), the data signals loaded into pixels 22 may have the maximum voltage normally used in controlling light-emitting diode 26 and the ratio of Ton/Toff may be used to establish the brightness of pixels 22.

Figure 4:
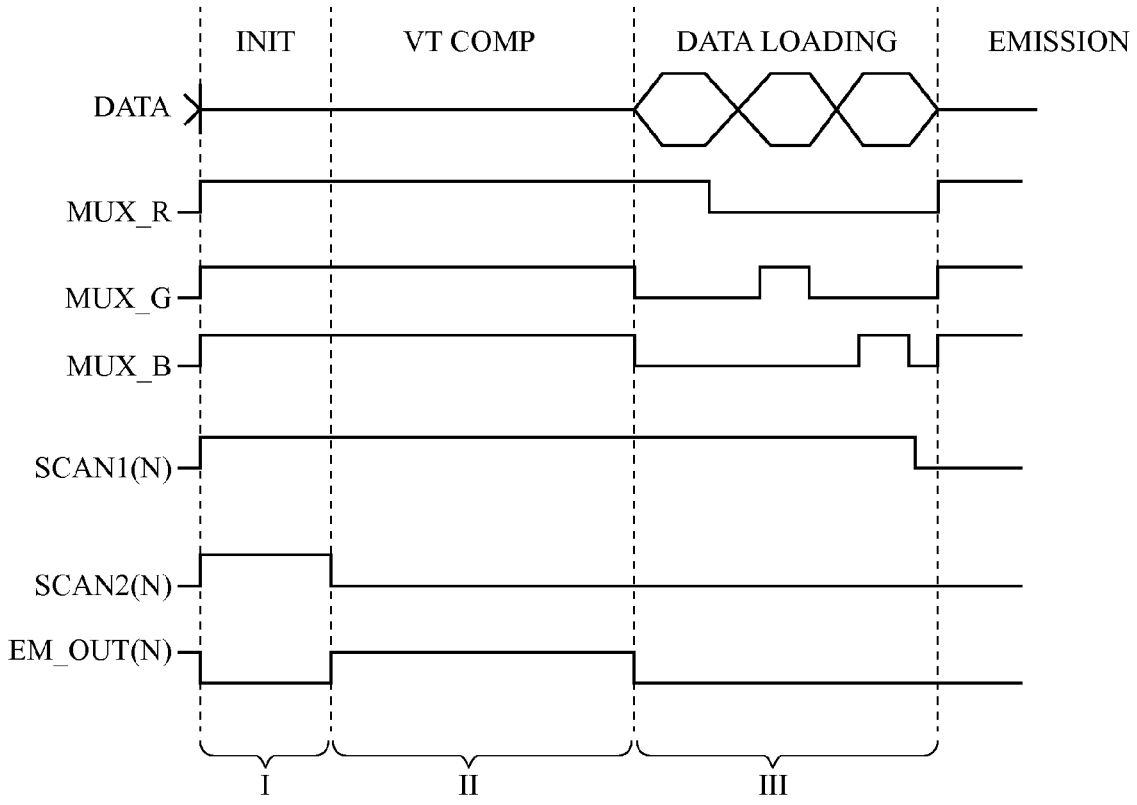
FIG. 4 is timing diagram illustrating operations involved in using a pixel circuit of the type shown in FIG. 3 in accordance with an embodiment.

FIG. 4 is a timing diagram showing how the signals of FIG. 3 may be controlled prior to emission. During periods I, II, and III, initialization operations are performed, threshold voltage compensation operations are performed, and data loading operations are performed. The pattern of control signals that are used during periods I, II, and III may vary as a function of the type of pixel circuit design that is used in implementing pixels 22. In the example of FIG. 4, EM_OUT is low during period I, is high during period II, and is low in period III. In pixel circuits of other designs, EM_OUT will have other patterns (e.g., EM_OUT may be low during periods I, II, and III in a 6T1C design, etc.). The example of FIG. 4 is merely illustrative.

During emission period EMISSION (i.e., following threshold voltage compensation and data loading operations), signal EM_OUT may be modulated using a PMW scheme. During some portions of the EMISSION phase (periods Ton), EM_OUT is high and current can flow through diode 26 to emit light 24. During other portions of the EMISSION phase (periods Toff), EM_OUT is low and current flow through diode 26 is inhibited. By varying the ratio of pulse-width-modulation on period Ton to pulse-width-modulation off period Toff, the magnitude of light output from pixels 22 can be controlled.

Figure 5:
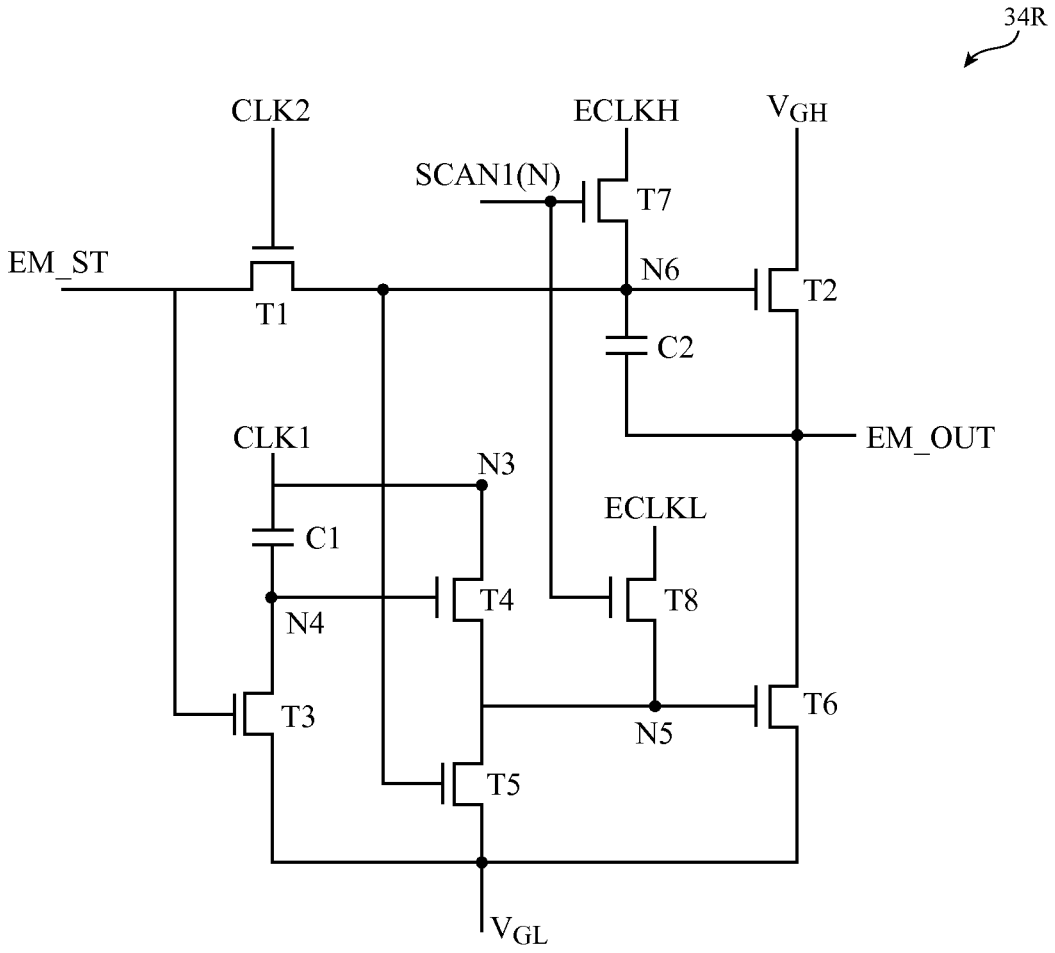
FIG. 5 is a circuit diagram of an illustrative emission control gate driver circuit in accordance with an embodiment.

FIG. 5 is a circuit diagram of an illustrative emission control gate driver circuit that may be used in controlling signal EM_OUT so that EM_OUT has a desired behavior during periods I, II, and III and can serve as a PWM control signal for emission transistor TE during the EMISSION period. Emission control gate driver circuit 34R of FIG. 5 is associated with one of the rows of pixels 22 in display 14 and forms part of gate driver circuitry 34 (FIG. 2). In gate driver circuitry 34, a series of emission control gate driver circuits 34R are coupled together in series to provide emission control signals EM_OUT for each of the rows of pixels 22 in display 14.

As shown in FIG. 5, emission control gate driver circuit 34R receives an emission start signal EM_ST and provides a corresponding emission output signal EM_OUT. Circuit 34R is powered using positive power supply VGH and ground power supply VGL. Two different two-phase clocks are used to clock circuitry 34R. A first two-phase clock, which is sometimes referred to as an emission control clock, includes clock signals ECLKH and ECLKL. A second two-phase clock, which is sometimes referred to as a pulse-width-modulation (PWM) control clock, includes clock signals CLK1 and CLK2. The emission control clock and the PWM control clock are used during initialization, threshold voltage compensation, and data loading operations (periods I, II, and III). During period II, the rising edges of the emission control clock are used to define the rising and falling edges of EM_OUT for period II. The PWM control clock helps establish the falling edge of EM_OUT at the beginning of period I and the rising edge of EM_OUT at the end of period III.

The PWM control clock is also used during the EMISSION period. During PWM operations, EM_OUT will transition low at the rising edge of CLK1 when EM_ST is held low and EM_OUT will transition high at the rising edge of CLK2 when EM_ST is held high. By controlling EM_ST with the display driver circuitry, the periods in which EM_OUT is high (diode 26 is on) and EM_OUT is low (diode 26 is off) may be adjusted to adjust pixel brightness.

The use of two-phase clocking allows one clock phase to be used for pull-up operations and one clock phase to be used for pull-down operations and thereby helps avoid transition errors. Two-phase clock signals can also be used to generate small PWM step sizes. To minimize flicker (e.g., flicker that might arise using a 60 Hz clock), it may be desirable to use a relatively high frequency for PWM clocking (e.g., 240 Hz or 120 Hz). Other clock rates may be used, if desired.

Figure 6:
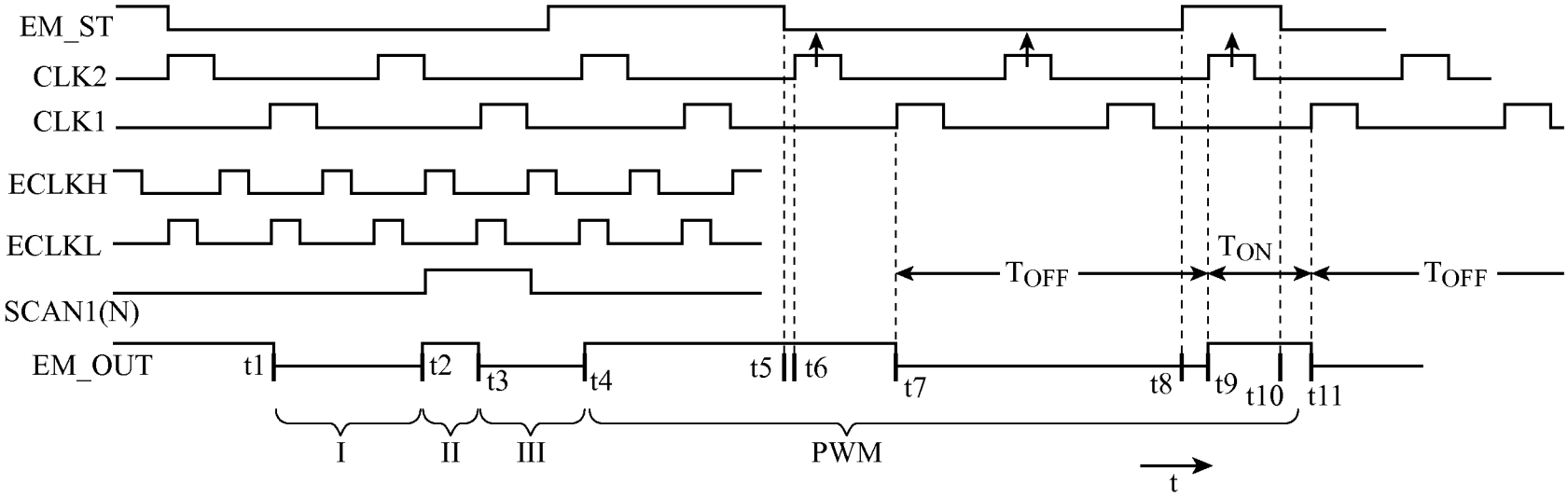
FIG. 6 is a timing diagram of illustrative signals involved in operating a display having emission control gate driver circuitry of the type shown in FIG. 5 in accordance with an embodiment.

A timing diagram that illustrates the operation of circuit 34R is shown in FIG. 6.

At time t1, CLK1 goes high, which takes node N3 of circuit 34R of FIG. 5 high. Node N4 goes high due to capacitive coupling from node N3 via capacitor C1. The high signal on node N3 propagates to node N5 and turns on T6, which pulls EM_OUT low, as shown in FIG. 6.

Between times t1 and t2, initialization operations are performed for pixel circuit 22 of FIG. 3 (in the present 4T2C example).

At time t2, SCAN1 goes high, which turns on transistors T7 and T8. With transistor T7 on, clock ECLKH pulls node N6 high, while T8 remains off. The high signal on node N6 turns on transistor T2, which pulls EM_OUT high.

Between times t2 and t3, SCAN1 is high and threshold voltage compensation operations may be performed (e.g., in the illustrative 4T2C scenario, threshold voltage compensation operations may be performed on the pixel circuit of FIG. 3 to compensate for variations in the threshold voltage Vt of drive transistor TD).

At time t3, SCAN1 remains high while ECLKH goes low and ECLKL goes high, which turns on transistor T6 and turns off transistor T2 and thereby pulls EM_OUT low.

Between times t3 and t4, signal EM_OUT is low and DATA may be loaded into pixel circuit 22 (i.e., the period between t3 and t4 may be used for data loading operations in the present example).

The operations illustrated between times t1 and t4 show how circuit 34R may be used to generate the EM_OUT waveform needed between t1 and t4 to perform voltage initialization (period I), threshold voltage compensation (period II), and data loading (period III) for a pixel having a circuit of the illustrative type shown in FIG. 3 (e.g., a 4T2C circuit). If desired, the clocks used in controlling circuit 34R may be adjusted to produce EM_OUT waveforms suitable for use with pixel circuits of other designs (e.g., a 6T1C design, a 7T1C design, etc.). The operation of circuit 34R between times t1 and t4 of FIG. 6 is merely illustrative.

At times after t4, PWM control operations may be used to control the brightness of light-emitting diodes 26. During PWM control operations, emission start signal EM_ST serves as a control signal that determines whether EM_OUT is to be taken high (for a PWM on period Ton) or is to be taken low (for a PWM off period Toff). Signal EM_OUT serves as a pulse-width-modulated emission enable signal that adjusts the brightness of light-emitting diodes 26.

In the example of FIG. 6, EM_ST is taken low at time t5. When CLK2 goes high at time t6, node N6 is pulled low, which turns off transistors T2 and T5. When clock CLK1 goes high at time t7, node N3 goes high. Node N4 then goes high via capacitive coupling through capacitor C1. When node N4 goes high, node N5 is pulled high and turns on transistor T6, thereby pulling EM_OUT low and starting the off period Toff.

When it is desired to take EM_OUT high (i.e., when it is desired to assert EM_OUT to start a PWM on period Ton), EM_ST is taken high (time t8). After EM_ST has transitioned high at time t8, the rising edges of clock CLK2 serve to monitor the status of EM_ST. In the example of FIG. 6, CLK2 rises at time t9, which causes EM_OUT to go high. In particular, when CLK2 goes high, transistor T1 is turned on. Emission start signal EM_ST is high, so turning on transistor T1 causes node N6 to go high. This turns on transistor T2 and pulls EM_OUT high. Transistor T5 is turned off, so node N5 goes low to turn off transistor T6 while EM_OUT is being pulled high.

When it is desired to take EM_OUT low (i.e., to deassert EM_OUT) to start another PWM off period (Toff), EM_ST is taken low (time t10). At time t11, CLK1 goes high. N4 is therefore taken high via capacitive coupling through capacitor C1. This turns on transistor T4 and takes node N5 high. With node N5 high, transistor T6 is turned on and EM_OUT is pulled low. This process continues until it is time to perform another set of initialization, threshold voltage compensation, and data loading operations (e.g., to load data for another frame).

Figure 7:
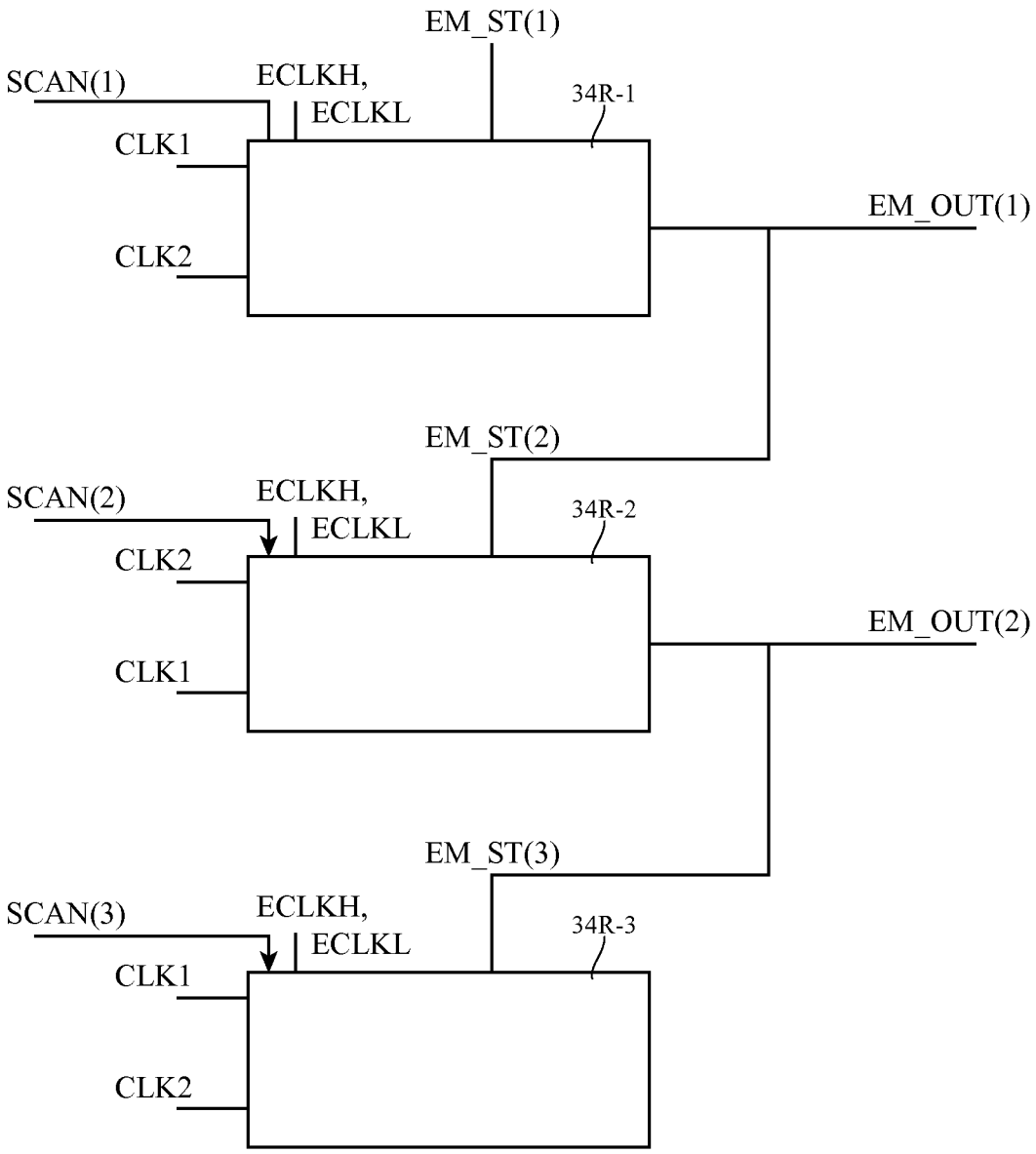
FIG. 7 is a diagram showing how a set of emission control gate driver circuits may be coupled in series to form a portion of the gate driver circuitry for a display in accordance with an embodiment.

As shown in FIG. 7, gate driver circuitry 34 of FIG. 2 may contain a chain of circuits 34R. Circuit 34R-1 may be used to produce signal EM_OUT(1) for the first row of pixels 22 in display 14, circuit 34R-2 may be used to produce signal EM_OUT(2) for the second row of pixels 22, circuit 34R-3 may be used to produce signal EM_OUT(3) for the third row, etc. Each circuit 34R may receive clocks CLK1 and CLK2 and clocks ECLKH and ECLKL. The signal assignments for clocks CLK1 and CLK2 may alternate (e.g., CLK1 may serve as CLK1 of FIG. 5 in odd rows and may serve as CLK2 of FIG. 5 in even rows and CLK2 may serve as CLK2 of FIG. 5 in odd rows and may serve as CLK1 of FIG. 5 in even rows). A different version of emission start signal EM_ST may be provided to the circuit 34R in each row. For example, signal EM_ST(1) may be provided to circuit 34R-1, signal EM_ST(2) may be provided to circuit 34R-2, signal EM_ST(3) may be provided to circuit 34R-3, etc.

Circuits 34R may be coupled together in series so that the output of each circuit 34R is provided as an input to the circuit 34R in a successive row. As shown in FIG. 7, the output of each row may be driven onto the emission control line (in path G) for that row and may also be provided to the circuit 34R in the next row. For example, EM_OUT(1) may be provided to pixels 22 in the first row of display 14 to serve as an emission enable signal and at the same time may be provided to circuit 34R-2 in the second row of display 14 to serve as signal EM_ST(2) for circuit 34R-2. This arrangement allows the rows of display 14 to be sequentially loaded with data and then operated in a PWM emission mode.

Figure 8:
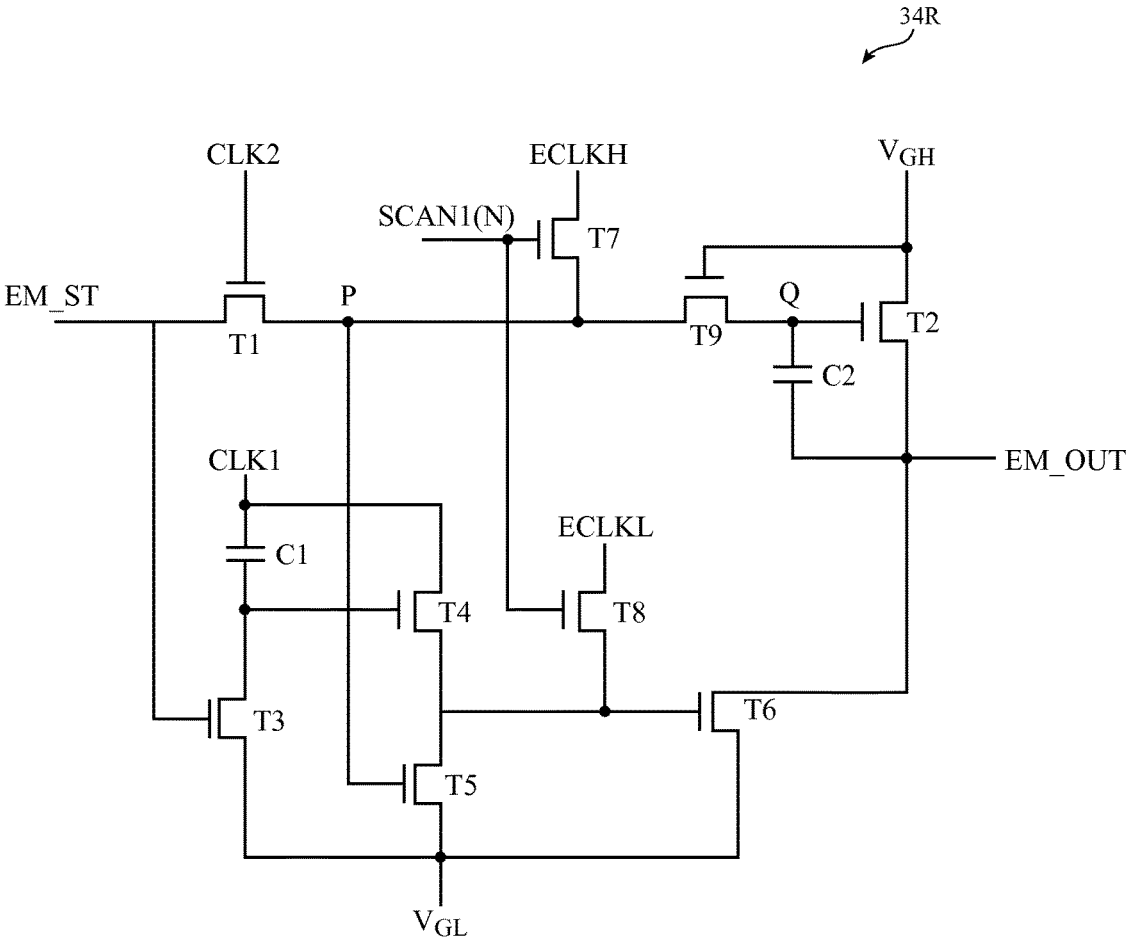
FIG. 8 is a circuit diagram of another illustrative emission control gate driver circuit in accordance with an embodiment.

FIG. 8 is a circuit diagram of another illustrative configuration that may be used for emission control gate driver circuit 34R. With the configuration of FIG. 8, node Q will be bootstrapped to a voltage higher than VGH by capacitor C2 when node P is pulled high by transistor T1 or T7. This helps fully turn on transistor T2 when pulling EM_OUT high. At the same time, node P will not exceed voltage VGH, thereby reducing high drain-source voltage stress (VDS stress) on transistors T7 and T1.

Figure 9:
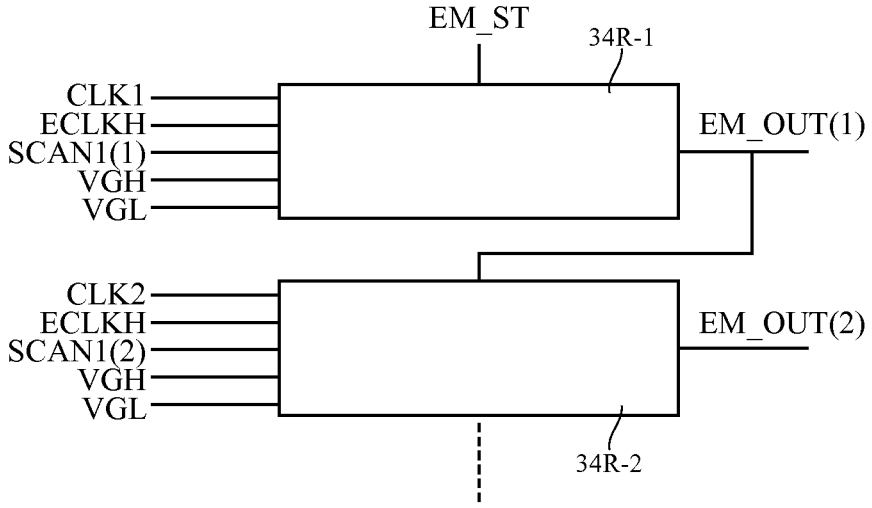
FIG. 9 is a diagram showing how a set of emission control gate driver circuits may be coupled in series to form a portion of the gate driver circuitry for a display in accordance with another embodiment.

In the illustrative configuration of FIG. 9, the gate driver circuitry for display 14 uses a single-phase clock ECLKH rather than a two-phase clock (e.g., ECLKH/ECLKL). Circuits 34R in odd rows receive clock signal CLK1 and clock signal ECLKH, whereas circuits 34R in even rows receive clock signal CLK2 (the second phase of two-phased clock CLK1/CLK2) and clock signal ECLKH (i.e., the same single phase of clock ECLKH that is provided to the odd rows).

Figure 10:
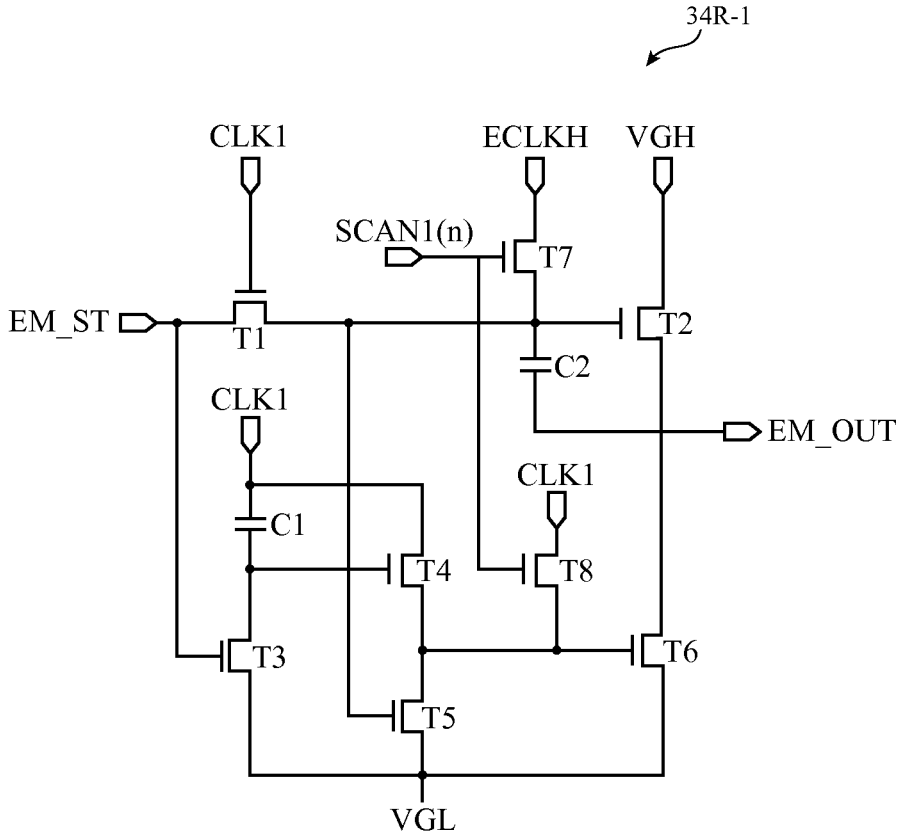
FIG. 10 is a circuit diagram of an illustrative emission control gate driver circuit of the type that may be used in the gate driver circuitry of FIG. 9 in accordance with an embodiment.

Illustrative circuitry for the circuits 34R of FIG. 9 (e.g., circuit 34R-1) is shown in FIG. 10. As shown in FIG. 10, one of the two phases of clock CLK1/CLK2 (i.e., first phase CLK1 in circuit 34R-1 of FIG. 10) is provided to clock input terminals coupled to transistor T1, capacitor C1 and transistor T4, and transistor T8. The single-phase clock ECLKH is applied to the clock input terminal of transistor T7.

Figure 11:
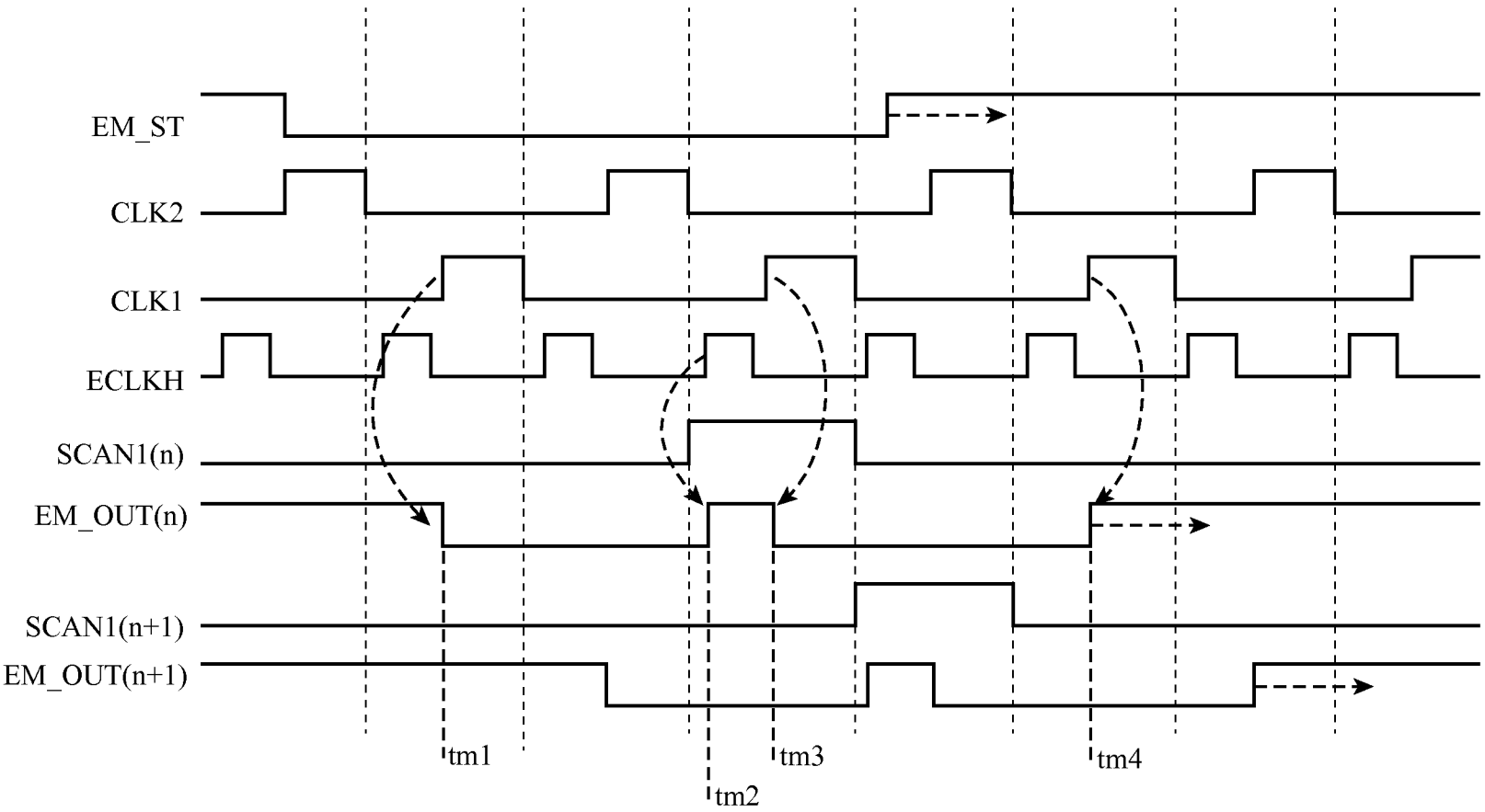
FIG. 11 is a timing diagram of illustrative signals involved in operating a display having emission control gate driver circuitry of the type shown in FIG. 10 in accordance with an embodiment.

A timing diagram illustrating the operation of emission control gate driver circuitry of the type shown in FIG. 10 is shown in FIG. 11. As shown in FIG. 11, the rising edge of clock CLK1 (in odd rows) defines the falling edge of signal EM_OUT(n) at time tm1, the rising edge of clock ECLKH defines the rising edge of EM_OUT(n) at time tm2, the rising edge of clock CLK1 defines the falling edge of EM_OUT(n) at time tm3, and the rising edge of clock CLK1 defines the rising edge of EM_OUT(n) at time tm4.

The foregoing is merely illustrative and various modifications can be made by those skilled in the art without departing from the scope and spirit of the described embodiments. The foregoing embodiments may be implemented individually or in any combination.

What is claimed is:

1. A display, comprising:

a pixel array having rows and columns of pixels each having a light-emitting diode and a transistor coupled in series with the light-emitting diode; and display driver circuitry that supplies data to the pixels via data lines and that supplies control signals to the pixels via gate lines, wherein the display driver circuitry includes a plurality of emission control gate driver circuits each of which produces a corresponding pulse-width-modulated emission enable signal that is supplied to the transistors of the pixels in one of the rows, wherein each emission control gate driver circuit receives first and second two-phase clocks and uses the first and second two-phase clocks to generate the corresponding pulse-width modulated emission enable signal, wherein the first two-phase clock has first and second clock signals with a first frequency, wherein the second two-phase clock has third and fourth clock signals with a second frequency that is different than the first frequency, and wherein the second clock signal is delayed with respect to the first clock signal while the fourth clock signal is delayed with respect to the third clock signal.

2. The display defined in claim 1 wherein the emission control gate driver circuits each receive a respective emission start signal.

3. The display defined in claim 2 wherein the pulse-width-modulated emission enable signal for each row serves as the emission start signal of a successive row and is received by the emission control gate driver circuit of the successive row.

4. The display defined in claim 3 wherein the pulse-width-modulated emission enable signal of each row is asserted during pulse-width-modulation on periods in which the light-emitting diodes of that row are turned on by turning on the transistors in that row using the pulse-width-modulated emission enable signal and is deasserted during pulse-wide-modulation off periods in which the light-emitting diodes of that row are turned off by turning off the transistors in that row using the pulse-width-modulated emission enable signal.

5. The display defined in claim 4 wherein the emission start signal is adjusted to control the pulse-width-modulation on periods and off periods.

6. The display defined in claim 5 wherein the pulse-width-modulation on periods and off periods have starting and ending times and wherein the first two-phase clock is a pulse width-modulation control clock and has two signals with edges that determine the starting and ending times in conjunction with the emission start signal.

7. The display defined in claim 6 wherein each pixel includes a drive transistor coupled in series with the transistor and the light-emitting diode.

8. The display defined in claim 7 wherein the third and fourth clock signals have edges that determine when the emission enable signal transitions during threshold voltage compensation operations.

9. The display defined in claim 1 wherein the first and second two-phase clocks control emission enable signal transitions.

10. The display defined in claim 9 wherein the first two-phase clock is a pulse-width-modulation control clock that controls transitions between pulse-width-modulation on periods in which the light-emitting diodes emit light and pulse-width-modulation off periods in which the light-emitting diodes do not emit light.

11. The display defined in claim 10 wherein the second two-phase clock is an emission control clock that controls emission enable signal transitions during threshold voltage compensation operations.

12. The display defined in claim 11 wherein each pixel includes a drive transistor coupled between the transistor and the light-emitting diode and wherein the threshold voltage compensation operations compensate for threshold voltage variations in the drive transistors.

13. A display, comprising:

an array of pixels each of which has a light-emitting diode, a drive transistor coupled to the light-emitting diode, an emission enable transistor coupled in series with the light-emitting diode and the drive transistor, and switching transistors; and display driver circuitry that supplies data to the pixels via data lines and that supplies control signals to the pixels via gate lines, wherein the display driver circuitry includes emission control gate driver circuits each of which produces a corresponding pulse-width-modulated emission enable signal that is supplied to the emission enable transistors in a respective row of pixels in the array, wherein the emission control gate driver circuits each receive a pulse-width-modulation control clock, and wherein the pulse-width-modulation control clock controls transitions between pulse-width-modulation on periods in which the pulse-width-modulated emission enable signal is asserted and the light-emitting diodes emit light and pulse-width-modulation off periods in which the pulse-width-modulated emission enable signal is deasserted and the light-emitting diodes do not emit light.

14. The display defined in claim 13 wherein the emission control gate driver circuits each receive an emission control clock.

15. The display defined in claim 14 wherein the emission control clock controls emission enable signal transitions during threshold voltage compensation operations for the drive transistors.

16. Display driver circuitry for supplying control signals to organic light-emitting diode display pixels each of which has an organic light-emitting diode, a drive transistor coupled to the organic light-emitting diode, and an emission enable transistor coupled in series with the organic light-emitting diode and the drive transistor, comprising:

an emission control gate driver circuit that receives an emission start signal, that receives a two-phase emission control clock, that receives a two-phase pulse-width-modulation control clock, and that provides a pulse-width-modulated emission enable signal to the emission enable transistors to control light emission from the organic light-emitting diodes based at least on the emission start signal, the two-phase emission control clock, and the two-phase pulse-width-modulation control clock, wherein the two-phase emission control clock controls the pulse-width-modulated emission enable signal during a threshold voltage compensation period, and wherein the emission start signal and the two-phase pulse-width-modulation control clock control the pulse-width-modulated emission enable signal during an emission period.

* * * * *